United States Patent [19]

Wendel

[11] Patent Number: 4,904,108

[45] Date of Patent: Feb. 27, 1990

[54] GEO HUB

[76] Inventor: Wendel R. Wendel, 184 Main St., Cold Spring Harbor, N.Y. 11724

[21] Appl. No.: 174,210

[22] Filed: Mar. 28, 1988

[51] Int. Cl.[4] ..... F16B 7/00

[52] U.S. Cl. ..... 403/173; 52/81; 403/356; 403/379; 403/359; 403/273; 403/268

[58] Field of Search ..... 403/171, 172, 176, 174, 403/356, 378, 379, 359, 273, 282, 268, 87, 103, 116, 408.1, 388, 292

[56] References Cited

U.S. PATENT DOCUMENTS

| | | | |
|---|---|---|---|
| 1,203,267 | 10/1916 | Reeves | 403/356 |
| 1,291,388 | 1/1919 | Bright et al. | 403/273 |
| 1,388,657 | 8/1921 | Macdonald et al. | 403/273 |
| 1,403,309 | 1/1922 | Follows | 403/282 |
| 4,097,168 | 6/1978 | Pagel | 403/388 |
| 4,172,678 | 10/1979 | Schönwald et al. | 403/268 |
| 4,337,937 | 7/1982 | Lopez | 403/379 |
| 4,449,843 | 5/1984 | Wendel | 403/173 |
| 4,509,381 | 4/1985 | Ikemoto et al. | 403/282 |
| 4,657,428 | 4/1987 | Wiley | 403/256 |
| 4,769,897 | 9/1988 | Moseman | 403/282 |

*Primary Examiner*—Andrew V. Kundrat
*Assistant Examiner*—Carol I. Bordas
*Attorney, Agent, or Firm*—Wallace J. Nelson

[57] ABSTRACT

A structural connection device is disclosed and is formed of a plurality of hub components having extending ear pairs for connecting with elongated struts or the like for constructing spatial structures. The hub components are positioned in stacked abutting relationship and connected into a unitary device via a single elongated rod connector disposed through and sealed within a large single axially aligned perforation extending centrally through each of the hub components. Adjacent hub components are rotated relative to each other prior to assembly to provide an angular relationship between the respective ear pairs of adjacent hub components.

The elongated rod connector 16 (FIGS. 1–2), and 16*a* (FIG. 3) is fixed to the hub components by shrink fitting, force fitting or adhesively bonding. Other connection embodiments utilize a key-keyway arrangement (FIGS. 4–5*a*), a cross-pin arrangement (FIGS. 6–7*a*) and a star or gear shaped connector element (FIGS. 8–9).

Custom angled ear pairs are provided by utilizing a center connector element having a rounded end 117 and bolting one or more ear pairs 119 thereto at the desired angular relationship (FIG. 12).

20 Claims, 4 Drawing Sheets

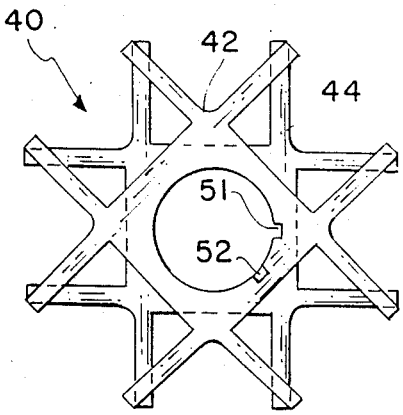
FIG. 4
FIG. 5
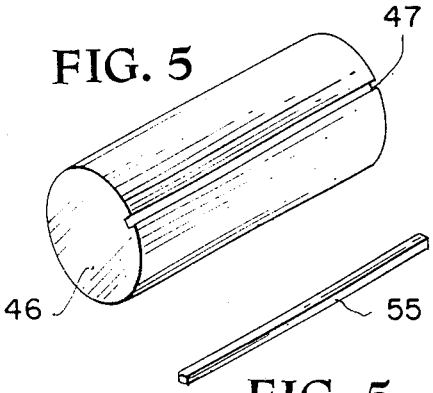
FIG. 5a
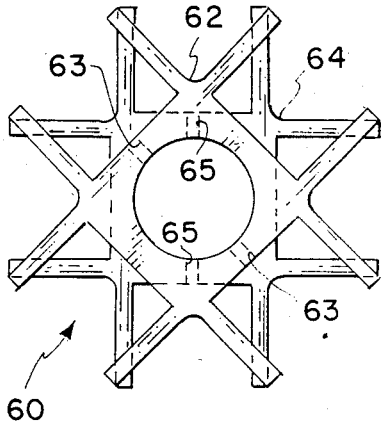
FIG. 6
FIG. 7
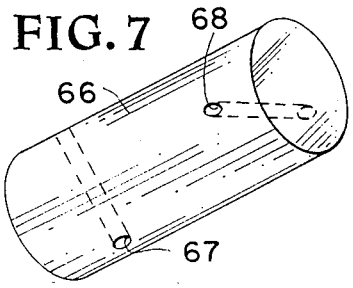
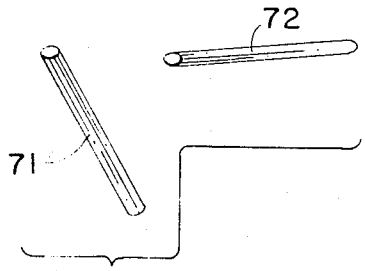
FIG. 7a

GEO HUB

FIELD OF THE INVENTION

This invention relates to connection devices for a plurality of elongated structural members in the fabrication of truss structures and the like.

BACKGROUND OF THE INVENTION

Structural configurations known as space frames or spatial structures, wherein a plurality of elongated struts are interconnected via a system of nodes or hubs, are well known in the art. One successful hub for such structures is disclosed in U.S. Pat. No. 4,449,843 wherein two hub components are precompressed together by a suitable bolt to form a structural unit capable of transferring axial and shear loads from the struts attached to the hub components. Although this prior art system has generally proved adequate for the purposes intended, it is not perfect and there are problems in manufacture and use thereof. For example, when the bolt used in this prior art system is formed of aluminum, it is difficult or impossible to precompress the aluminum hub components to sufficient values to accommodate significant diagonal loads or to ensure against relative rotation of the hub components.

Accordingly, constructing the bolt of high strength steel is required in order to effect adequate precompression between the hub components to maintain configurative stability of the hub. This difference in materials creates a potential problem of material compatibility and galvanic corrosion between the parts. To avoid this potential problem great care and expense has been expended to have the high strength steel bolts cadmium plated to minimize galvanic action. In addition, the size of the center bolt must be varied to meet various load requirements for efficiency.

There is thus a definite need in the art for an improved hub for connecting multiple strut members in a spatial structure. The present invention is an improvement over the prior art and is intended to include all the advantageous features while minimizing the disadvantages thereof.

SUMMARY OF THE INVENTION

Accordingly, it is an object of the present invention to provide a new and improved connection system for interconnecting multiple structural members in a spatial structure.

It is another object of the present invention to provide a hub assembly constructed of two or more parts integrally secured together without precompressing the parts.

It is a further object of the present invention to provide a novel hub assembly for use in construction of spatial structures formed of multiple parts and connected together into an integral unit without precompressing the parts.

It is a further object of the present invention to provide a pin connection for attaching individual struts to the hub assembly ears.

Another object of the present invention is a novel method of securing together multiple hub components into a unitary connection device for a plurality of structural members.

According to the present invention the foregoing and additional objects are attained by providing a pair or multiple hub extension components disposed in stacked, abutting relationship. Each member of the hub components is provided with a large single perforation extending through, and a plurality of spaced ear pairs integrally extending from, a center portion thereof. Adjacent hub components in the assembly are rotated relative to each other to define an angular relationship between the respective ear pairs of adjacent hub components.

A single elongated rod connector is disposed through and sealed within the large single perforation of each abutting hub component to form a unitary hub structure. The elongated rod connector is attached to each hub component to maintain the unitary hub structure, and ensure against relative rotation of the hub components parts, by one or more procedures including shrink fitting, adhesively attaching, force fitting, keying, and cross-pin connections.

BRIEF DESCRIPTION OF THE DRAWINGS

A more complete appreciation of the invention and many of the attendant advantages thereof will be readily apparent as the same becomes better understood by reference to the following detailed description when considered in connection with the accompanying drawings wherein:

FIG. 4 is a part schematic, top plan view of a connection device similar to FIG. 1 and illustrating another embodiment of the present invention;

FIG. 5 is a perspective view of a cylindrical rod connector element for use with the embodiment of the present invention shown in FIG. 4;

FIG. 5*a* is a view of a key connector for use with the connection device and rod connector element shown in FIGS. 4 and 5;

FIG. 6 is a part schematic, top plan view of another embodiment of the connection device of the present invention;

FIG. 7 is a perspective view of a cylindrical rod connector element for use with the embodiment of the present invention shown in FIG. 6;

FIG. 7*a* illustrates two cross-pins that are used to connect the rod connector element shown in FIG. 7 within the assembly of FIG. 6;

DETAILED DESCRIPTION OF THE INVENTION

Figure 1:
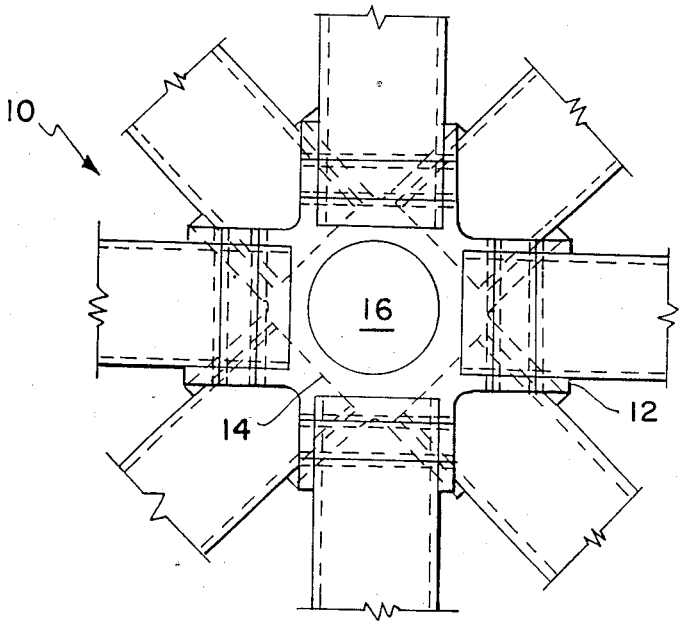
FIG. 1 is a top plan view of the preferred embodiment of a connection device in accordance with the present invention and illustrating the strut ends attached thereto.
Figure 2:
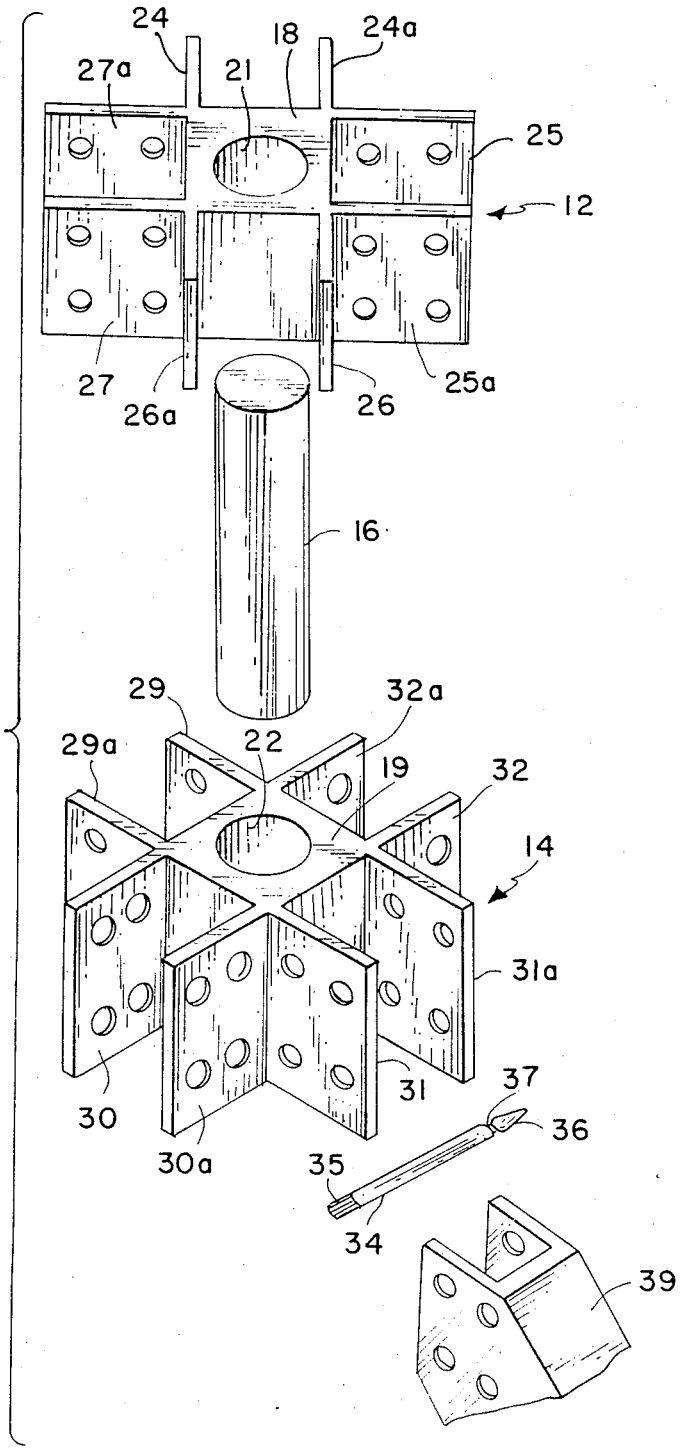
FIG. 2 is an exploded view of the hub components making up the connection device of FIG. 1 with the strut ends, save one, and other parts being omitted in the interest of clarity.

Referring now to the drawings, and more particularly to FIGS. 1 and 2, the preferred embodiment of the connection device of the present invention is shown and generally designated by reference numeral 10. Connection device 10 is typically formed of two basic identical hub components 12 and 14 rotated forty-five degrees relative to each other and disposed in abutting relationship. Hub components 12 and 14 are connected into a unitary structure by a cylindrical rod element 16 extending therethrough. Hub components 12 and 14 are each provided with an essentially square central portion designated, respectively, by reference numerals 18 and 19. A single perforation or through opening is provided in each central portion 18,19 as designated, respectively, by reference numerals 21,22.

Rod connector element 16 extends through the openings 21,22 and serves to connect hub components 12,14 into a unitary structure, as will be further explained hereinafter. As illustrated, each hub component 12,14 has four identical sets of spaced ears integrally extending, one pair each, from the four sides of central portions 18,19. Other hub components having three, six or more ear pairs may be employed, as will be further explained hereinafter. As illustrated, hub components 12,14 are rotated forty-five degrees relative to each other such that the paired ears of one hub component are also disposed forty-five degrees relative to the paired ears on the abutting hub component. In some instances, the joined hub components 12,14 may be rotated at different angles, for example, thirty degrees relative to each other. The paired ears on hub component 12 are designated by reference numerals 24 and **24*a*; 25 and 25*a*; 26 and 26*a*; and, 27 and 27*a*. The ears of hub component 14 are designated by reference numerals 29 and 29*a*; 30 and 30*a*; 31 and 31*a*; and, 32 and 32*a***. Each of the ears on both hub components is provided with a number of equal size holes transversely therethrough with the holes on each member of the pair being in axial alignment with the holes in the other member of the pair. The number of holes employed for different ear pairs may vary, with two, four and six holes being employed as determined by the number of pins required to sustain the load to be exerted on the connection device. These holes are not designated by reference numerals in the drawings, in the interest of clarity, and serve to receive elongated pin members therethrough to connect an individual strut between each pair of ears.

Figure 3:
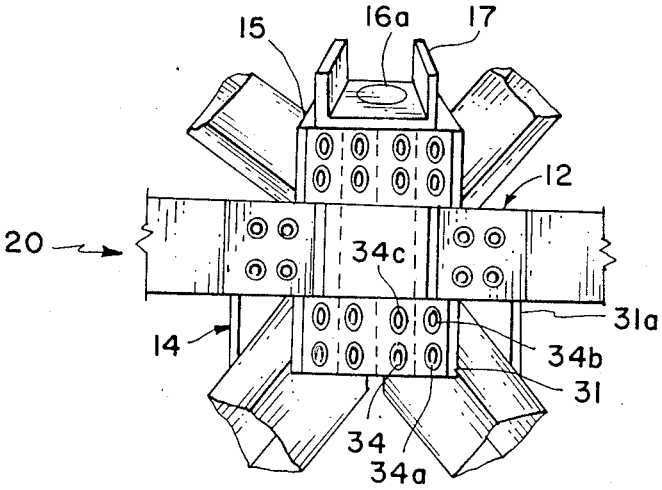
FIG. 3 is a side view of a connection device similar to that shown in FIGS. 1 and 2 but employing additional hub components.

These connecting pins are available in a variety of sizes and are manufactured under the trade name STAR*PIN by Starnet Structures Inc., 106 Bell Street, West Babylon, N.Y. 11704. One such pin member 34 is shown in FIG. 2. Pin 34 and three identical pins, **34*a*, 34*b*, and 34*c* (FIG. 3) extend through the four aligned holes of ear 31, both sides of strut 39 and ear 31*a* to attach strut 39 to connector element 10. Other identical pins, also arranged in groups of two, four or six, and not designated, serve to connect a strut to each pair of ears on hub components 12, 14 as shown in FIGS. 1–3**.

Connecting pin 34, and the other identical pins, are each provided with a knurled exterior surface 35 over a portion of the length at one end thereof and a breakaway tapered tip 36 at the other end thereof. The tapered tip 36 serves to assist in positioning pin 34 through the aligned holes in ear pair **31, 31*a* and strut 39. Knurled surface 35** is slightly larger than the holes in the ears and is forcibly driven therein to obtain a binding frictional fit between the pin and ear. Preferably, these pins are formed of cadmium coated 41L40 steel, or equivalent material.

In operation, after pin 34 is positioned completely within ear pair **31,31*a* containing strut end 39, such that the end 35 of pin 34 is flush with the exterior surface of ear 31, tapered tip 36 is broken off at the reduced diameter area 37 thereof to leave this end flush with the exterior surface of ear 31*a*. Although tapered tip 36 is easily broken off at weakened area 37, by striking an angular hammer blow thereto, the weakened area is of adequate strength to withstand sufficient axial force thereon to enable hammering of pin 34** into position.

In fabrication of the individual parts, hub components 12,14 are formed of a suitable aluminum alloy by extrusion. The large center openings 21,22 and the respective four pairs of ears are formed in the extrusion process and the necessary number of transverse holes in the ear pairs punched or drilled therethrough. After the individual hub components 12,14 are placed in stacked, abutting relationship and rotated the desired angular distance relative to each other, a high strength center rod connector element 16 is positioned to extend through openings 21,22 thereof and shrink fitted, form fitted, or otherwise fitted and secured therein.

Rod connector element 16 is also formed by extrusion of the same or similar material as that employed for hub components 12, 14. Rod connector element 16, as formed, is designed to have a diameter of several thousandths of an inch larger than the diameter of openings 21, 22.

Shrink form fitting is normally accomplished by eliminating any dimensional interference of two normally interfering parts during assembly of the parts. Dimensional interference is normally eliminated by heating one part only, cooling one part only or by heating one part and cooling the other. An expansion fit is achieved by cooling only the male or internal member of an assembly. The term "shrink fit" as used herein is intended to embrace both concepts. The general advantages of expansion fits over ordinary press fitting are the greater allowances possible with nitrogen or dry ice cooling and the freedom from longitudinal scratches that may be formed by press fitting.

Prior to being positioned within hub components 12,14, rod connector element 16 is cooled by immersion in dry ice or liquid nitrogen to a possible temperature differential of approximately 215° C. from room temperature. This cooling of rod connector element 16 effects adequate temporary shrinkage thereof to permit easy insertion within openings 21,22 of hub components 12,14. After hub components 12, 14 are stacked in abutting regular relationship, as described hereinabove, super cooled rod connector element 16 is removed from the cooling medium and rapidly and centrally positioned within the aligned through openings 21,22. After permitting the assembled parts to reach room temperature, rod connector element 16 will have expanded to its original size as much as permitted by the surrounding structure of hub components 12,14. Inasmuch as rod connector element 16 is designed several thousandths of an inch larger than the openings 21,22, a resulting tight connection is formed between the parts.

In some instances, hub components 12,14 may be heated to effect temporary expansion thereof in lieu of or in addition to the super-cooling of rod connector element 16. Heating of hub components 12,14 is readily accomplished by the use of steam, electric resistance or induction heaters or the like. Heating should normally be restricted to less than 240° C. to prevent damage to the aluminum parts. Subzero refrigeration does not distort, warp or otherwise adversely affect the aluminum. A low humidity environment is essential to prevent bad joints being formed due to condensation and moisture trapped between the fitted parts. For successful shrink fittings it is also necessary that the parts be machined or extruded accurately, all parts should be clean (degreased) and throughly dried prior to the heating or cooling assembly. Also, all corners or edges should be chamfered and assembly should be rapid with accurate centering of the parts when removed from the heating or cooling medium.

The shrink or expansion fit of rod connector element 16 within hub components 12,14 bonds the hub components into an essentially unitary structure where center rod connector element 16 serves to transfer all forces and moments between the individual hub components. Rod connector element 16, alone, has the capacity to transfer the forces and moments whereas in the prior art patent, U.S. Pat. No. 4,449,843, the center bolt, by itself, does not have the capacity to transfer the forces and moments. This improvement is partially due to the center bolt in the patented device being only about one-half the diameter of the solid rod connector element 16 of the present invention and partially due to the center bolt being threaded which further reduces the diameter to its solid portion.

FIG. 3 shows the structure illustrated and described in reference to FIGS. 1 and 2 with the addition of a longer center rod connector element **16*a* being employed to connect four hub components into a unitary connection device 20. As shown therein, center rod connector element 16*a* extends through hub components 12, 14, 15 and 17. Hub component 15 is identical to hub components 12 and 14 while hub component 17 is a U-channel component. An additional U-channel component may also be attached to the other end of center rod connector element 16*a*, when so desired. Suitable transverse holes are provided in the sides of U-channel 17 for attachment of an end of one or more elongated strut or structural members perpendicular or angular thereto. Rod connector center element 16*a* is secured within the hub components 12, 14, 15 and 17 as previously described in reference to FIGS. 1 and 2**.

Referring now more particularly to FIGS. 4, 5, and **5*a* an embodiment of the present invention employing a key connection will now be explained. In this embodiment connection device 40 is formed of identical hub components 42,44 disposed in a typically forty-five degree abutting angular relationship. A rod connector element 46 serves to connect hub components 42,44 into connection element 40. Rod connection element 46 is provided with a single longitudinal keyway or slot 47 extending along the surface length thereof. Similar keyways 51, 52 are formed in hub components 42 and 44 with only those of top component 42 being visible in FIG. 4. Thus, when identical hub components 42 and 44 are disposed in abutting angular relationship, one of the two keyways in the interior surface thereof may be aligned. Rod connector element 46 is then inserted through the hub components 42,44 and positioned such that keyway 47 thereon is disposed face-to-face with the aligned keyways of hub components 42,44. A suitable key 55 (FIG. 5*a*) may then be positioned through the aligned keyways of hub components 42,44 and the face-to-face aligned keyway of rod connector element 46 to lock the assembly. Key 55 is designed to have a length equal to the length of rod connector element 46 which is also equal to the combined thickness of hub components 42,44. Key 55 also is designed to have a thickness essentially equal to the combined depth of a keyway on hub connector elements 42,44 and the face to-face aligned keyway on rod connector element 46**.

In this embodiment rod connector element 46 is designed to have a diameter that forms a close fit with the openings through hub components 42,44. The remaining or empty keyway slot in each of hub components 42, 44 may be filled with a suitable polymer adhesive. Also, an adhesive layer or coating may be interposed between rod connector element 46 and hub components 42,44, or the key may be sized to be press fitted within the aligned keyways.

Referring now to FIGS. 6 and 7, another embodiment of the invention will now be described. In this embodiment connection device 60 is also formed of identical hub components 62,64 disposed in an abutting angular relationship.

Rod connector element 66 serves to connect hub components 62,64 into a unitary connection device 60. A pair of transverse openings or bores 67,68 are disposed in spaced relationship to each other and extend through rod connector element 66. Bores 67,68 are also spaced from the ends of rod connector element 66 and have the ends thereof angularly disposed relative t each other on the circumference of rod 66. Hub components 62,64 are provided with transverse bores 63,65 respectively, through the side walls thereof. For connection of hub components 62,64 into the unitary connection device 60, rod connection element 66 is positioned through hub components 62,64 such that bores 67,68 therein are in alignment with bores 63,65 of hub components 62,64. Cross-pins 71,72 (STAR*PINS or the like) are then inserted through the aligned bores to fixedly attach rod connector element 66 to hub components 62,64. A suitable polymer adhesive coating may be applied to each cross-pin 71,72 prior to it being positioned into place. Also, rod connector element 66, which is designed with a diameter that closely fits within hub components 62,64, may be coated with a suitable polymer adhesive. Cross-pins 71,72 may also be designed to have a tapered or knurled surface and be press-fitted into position.

Figure 8:
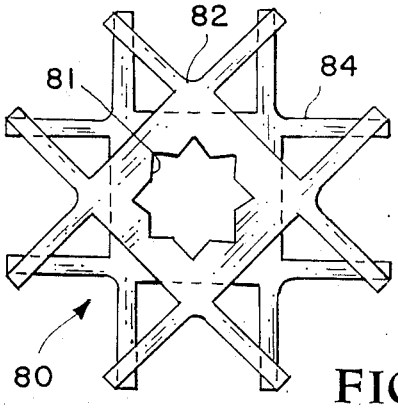
FIG. 8 is a view similar to FIG. 6 of another embodiment of the connection device of the present invention.
Figure 9:
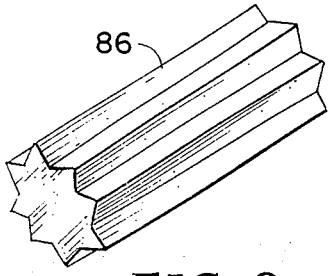
FIG. 9 is a view similar to FIG. 7 of a rod connector element for the embodiment of the present invention shown in FIG. 8.

Referring now to FIGS. 8 and 9 another embodiment of the present invention is shown and will now be described. In this embodiment, connection device 80 is formed of identical hub components 82,84 disposed in abutting relationship and rotated forty-five degrees relative to each other. The through opening or single perforation 81 extending through hub components 82,84 is an eight-point star or gear configuration with each point thereon being forty-five degrees from the adjacent point(s). When the job situation requires that hub components 82,84 be disposed in a thirty or sixty degree angular relationship, the through openings and star configured connector element are provided with a twelve point configuration with each point thereof being thirty degrees from the adjacent point(s). Rod connector element 86 is extruded to be a few thousandths of an inch larger or extruded to form a close fit within the openings formed through hub components 82,84. Thus, when rod connector element 86 is extruded to be a few thousandths larger than the opening within hub components 82,84, it may be shrink or expansion fitted therein as described relative to FIGS. 1–3, or it may be press-fitted within hub components 82,84. When rod connector element 86 is extruded to be a close fit, it is adhesively bonded within hub components 82,84 by use of a suitable polymer adhesive.

Figure 10:
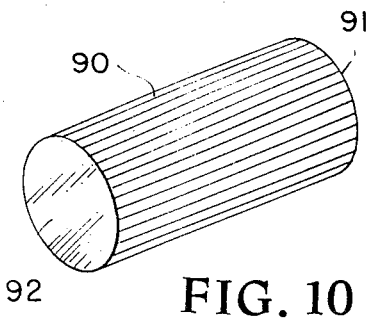
FIG. 10 is a view similar to FIG. 9 illustrating a modified rod connector element for use with the connection device illustrated in FIGS. 1–3.

In FIG. 10 a modified rod connector element 90 is shown and is designed particularly for use with the connection device assembly 10 illustrated in FIGS. 1–3. Rod connector element 90 is provided with a knurled or serrated surface over the entire length thereof and may be cylindrical or provided with a slight taper as illustrated, with the diameter of end 91 being machined slightly larger than end 92, perceptively, in FIG. 10. When it is desired to employ rod connector element 90 at a shrink fit or press fit connection, it is extruded a few thousandths of an inch larger than the opening in the hub components to be connected therewith. In both shrink fitting and press fitting (through use of a hydraulic press or the like) the serrated or knurled rod surface provides space for movement of any displaced rod material during the fitting process and results in a tight bond between the parts. Again, a suitable polymer adhesive may be interposed between rod element 90 and hub components 12,14, if so desired.

Figure 11:
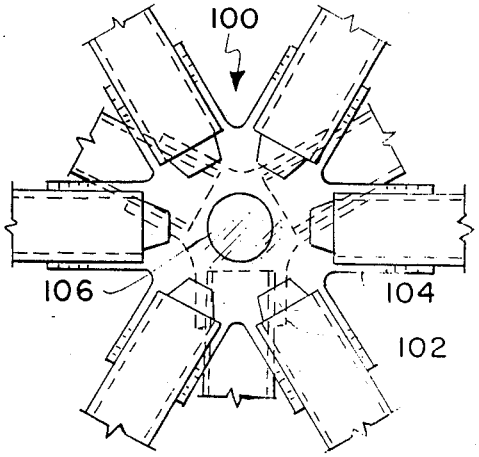
FIG. 11 is a top plan view of another embodiment of the present invention wherein a three and a six ear paired hub component are employed in a connection device; and, FIG. 12 illustrates another embodiment of the present invention wherein extended ear pairs may be bolted to a rounded end rod connected at any selected angle for unlimited geometric capabilities.

Referring now to FIG. 11, another embodiment of a connection device for structural members, according to the present invention, is shown and designated generally by reference numeral 100. Connection device 100 is formed of a pair of dissimilar hub components 102 and 104 disposed in stacked abutting relationship and rotated thirty degrees relative to each other. A rod connector element 106 extends through a central through opening provided in each of hub components 102 and 104 and serves to secure the components into a unitary structure, as in the previously described embodiments. The design of rod connector element 106 may be selected from any of the embodiments described hereinbefore and it is shrink fitted, adhesively secured, cross-pinned, keyed, press fitted, or a combination of one of these processes to construct connection device 100. Hub component 102 is provided with three identical pairs or sets of strut receiving, spaced ears, with each ear pair being disposed one hundred twenty degrees from an adjacent ear pair. Hub component 104 is provided with six identical pairs or sets of strut receiving ears with each ear pair being disposed sixty degrees apart about the hub center portion. As in the previous embodiments, connector unit 100 may also have other hub components attached thereto in addition to components 102 and 104 as needed for a specific job. Hub components having three and six ear pairs are normally employed in constructing triangular configured structures while hub components having two, four and eight ear pairs are normally employed in square and rectangular configured structures.

Figure 12:
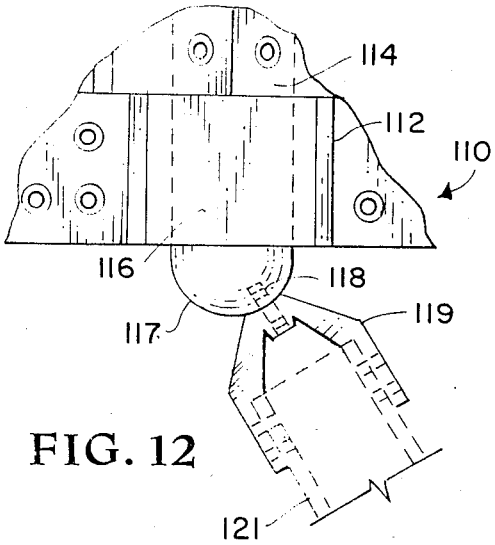

All portions of spatial structures do not always have thirty, sixty, forty-five or ninety degree angular relationships and custom geometry node or hub connection devices of different or unusual angles are sometimes required. One approach to obtaining these custom designs would be to cut a die for an extrusion where the ears are at the specific angular relationship required. Another approach is to extrude separate ear sections and bolt them individually to a rounded end of a center rod connector element or to a round or spherical hub. The embodiment of the present invention illustrated in FIG. 12, and designated generally by reference numeral 110, uses this latter approach Connection device 110 is formed of hub components 112 and 114 connected via a center rod connector 116. Rod connector 116 is extruded from a suitable aluminum alloy, as in the previously described embodiments and used to connect hub components 112 and 114. One end of rod connector element 116 extends from the connected hub components and is provided with a rounded configuration as designated by reference numeral 117. This is in contrast to the flush smooth surface formed with the hub components by the ends of rod 46, as used in the embodiment of FIG. 4. As shown in the drawing, bolt 118 is threaded into the rounded end 117 of rod connector 116 and serves to secure an extruded ear pair 119 thereto. Additional ear pairs (not shown) may be similarly attached to rounded end 117 perpendicular to hub component 112 or at any desired angular relationship therewith, as needed for a specific job application.

The angle between ear pairs attached to rounded end 117 is therefore not restricted to thirty, sixty, ninety, or one hundred twenty degrees, as in the embodiments described hereinbefore. For assembly, one or more holes are bored and tapped within the rounded end 117 of center rod 116 and an extruded ear pair 119, for example, secured thereto via bolt 118 and another bolt (not shown), if deemed necessary. Ear pair 119 is then ready to receive and connect with the end of an elongated structural member 121. The sides of ear pair 119 are normally extruded to be either three, or four, inches apart to selectively receive square or rectangular struts having three or four inch sides. This custom designed connector assembly, or variable angle capability, allows more potential geometries to be used in spatial structure construction. Also, it permits the use of standard extrusion geometries to be used with square or triangular configurations but at special locations, such as along the structural edges.

Although specific embodiments of the invention have been described herein, they are to be considered as exemplary of the novel features thereof and are not exhaustive. Aluminum and aluminum alloys have been mentioned as materials for making the various components of the specific examples. These include but are not limited to the aluminum alloys 6061-T6 and 7075-T6. Tests have indicated that hubs formed with two inch diameter cylindrical rods of these materials have more than twice the capacity of the bolted hubs of U.S. Pat. No. 4,449,843.

Also, no specific polymer adhesive has been described in the foregoing examples and exemplary adhesives for use in the embodiments described herein include HYSOL GA9434NA and EA9430 available from Hysol Aerospace and Industrial Productions, Division of Dexter Corporation, Seabrook, N.H.

There are obviously many variations and modifications of the specific exemplary examples described herein that will be readily apparent to those skilled in the art in the light of the above teachings without departing from the spirit or scope of the appended claims. It is therefore to be understood that the invention may be practiced otherwise than as specifically described herein.

What is claimed as new and desired to be secured by Letters Patent of the United States is:

1. A connection for structural members comprising:

at least a pair of hub components disposed in abutting relationship, each of said hub components having a central portion and a plurality of spaced ear pairs integrally extending from the circumference of said central portion, each said ear pair adapted to connect with the end of a structural member, said hub components being rotated with respect to each other to define an angular relationship between the respective ear pairs of adjacent hub components, said central portion of each said hub component being provided with a through opening disposed in axial alignment with an identical through opening in an abutting hub component, rod means extending through and positively attached to the through opening of each said central portion to connect said hub components into a unitary structure and serving to transfer all forces and moments between the individual hub components, said rod means having at least one end thereof forming a flush smooth surface on the same plane and in contiguous relationship with the surface of one of said hub components, said rod means being an elongated cylinder having a diameter equal to at least two-thirds the width of said central portion of each said hub component and having a length substantially equal to the combined thickness of said hub components.

2. A connection as in claim 1 wherein said at least a pair of hub components consists of a pair of identical hub components, each of said identical hub components having four spaced ear pairs disposed ninety degrees apart about said central portion and said identical hub components being rotated forty-five degrees relative to each other.

3. A connection as in claim 1 wherein said at least a pair of hub components consists of at least one hub component having three equally spaced ear pairs disposed about said central portion and at least one hub component having six equally spaced ear pairs disposed about said central portion and wherein said hub components are rotated thirty degrees relative to each other.

4. A connection as in claim 1 wherein said rod means is of cylindrical configuration, said rod means being formed of the same base material as said hub components and being expansion fitted into the through openings of said hub components.

5. The connection of claim 1 including an adhesive interposed between said rod means and each member of said hub components along the entire length of said rod means.

6. The connection of claim 1 including said rod means being provided with at least two spaced transverse passageways therethrough, at least one transverse opening extending through said central portion of each member of said hub components, said at least one transverse opening being disposed in alignment with one of said at least two transverse spaced passageways of said central passageway and a locking cross-pin disposed completely through said at least one transverse opening and one of said at least two transverse passageways to thereby unitarily lock said hub components together and prevent relative rotation therebetween.

7. The connection of claim 6 including a first adhesive coating interposed between each said cross-pin and the transverse passageways and the transverse openings receiving said cross-pins, and a second adhesive coating disposed along the entire length of said rod means and between said rod means and said hub components.

8. The connection of claim 1 including said rod means being provided with at least a portion of the length thereof of slightly larger diameter than the through openings in said central portions, said rod means further being provided with a slight tapered exterior surface along at least a portion of the length thereof and said rod means being forcibly positioned within the through openings to provide a press-fit connection therein.

9. The connection of claim 1 including said rod means having a longitudinal serrated exterior surface and being formed of a slightly larger diameter than the through opening in said central portion, said rod means being forcibly positioned within the through opening of each said central portion to connect said hub components into a unitary structure, and further including an adhesive coating interposed between said rod means and said hub components along the entire length of said rod means.

10. The connection as in claim 1 wherein said rod means is provided with at least one elongated key slot extending at least over a major portion of the exterior surface length thereof and the through openings in each said central portion also being provided with at least one elongated key slot extending the length of the through opening, said at least one elongated key slot in each said central portion being disposed in axial alignment with each other when said hub components are disposed in angular rotated relationship, said at least one elongated key slot in said rod means being disposed in face-to-face alignment with said at least one axially aligned key slot in said central portions, and unitary key means positioned within and filling said face-to-face aligned key slots to lock said hub components against relative rotation.

11. The connection of claim 1 wherein said rod means is provided with a pointed star configured circumferential exterior surface along the entire length thereof and the through openings in each member of said hub components are provided with interior flutes and ribs that mate with and receive said pointed star circumferential surface of said rod means.

12. The connection of claim 11 wherein said rod means is formed with a diameter a few thousandths larger than the through openings in said hub components and is expansion fitted therein.

13. The connection of claim 11 wherein said rod means is formed with a diameter a few thousandths larger than the through openings in said hub components and is force fitted therein.

14. The connection of claim 11 wherein said rod means is formed with a diameter essentially the same as that of the through openings in said hub components so as to form a close fit therein and including an adhesive layer interposed between said rod means and said hub components.

15. The connection of claim 1 wherein said plurality of spaced ear pairs extending from said central portion is a number of ear pairs selected from the numbers two, three, four and six ear pairs with each ear pair being constructed and arranged to receive an end of one of said structural members and having a plurality of pin members extending through said structural member and the ear pair receiving said structural member, said plurality of pin members being a number selected from the numbers two, four, and six, each said pin member having a knurled exterior surface over a portion of the length at one end thereof to provide a binding frictional fit between said pin and said structural member and thereby assist in maintaining said pin through said structural member and said pair of ears receiving said structural member.

16. A connection for structural members comprising:

at least a pair of hub components disposed in abutting relationship, each of said hub components having a central portion and a plurality of spaced ear pairs integrally extending from the circumference of said central portion, each said ear pair adapted to connect with the end of a structural member, said hub components being rotated with respect to each other to define an angular relationship between the respective ear pairs of adjacent hub components, said central portion of each said hub component being provided with a through opening disposed in axial alignment with an identical through opening in an abutting hub component, rod means extending through and positively attached to the through opening of each said central portion to connect said hub components into a unitary structure and serving to transfer all forces and moments between the individual hub components, said rod means having at least one end thereof forming a flush smooth surface with one of said hub components;

said rod means being provided with a rounded end portion extending from one of said hub components and at least one ear pair structure being bolted to said rounded end of said rod means.

17. A method for securing together at least two hub components to form a connection for a plurality of structural members comprising:

providing at least a pair of hub components having a central portion with axial through openings therein and a plurality of ear pairs extending from the periphery thereof, positioning the hub components in stacked abutting relationship with the through openings therein being in axial alignment, providing an elongated rod connector element of slightly larger diameter than that of the through openings, super cooling the elongated rod connector element by immersion in dry ice or liquid nitrogen for a period of time necessary to cause a rod connector element temperature differential of approximately 215° C. relative to room temperature to cause thermal reduction in the dimensions thereof, removing the super cooled rod connector element from the cooling medium and rapidly and centrally positioning the rod connector element within the through openings of the hub components, and permitting the super-cooled rod and hub components to attain room temperature to thereby effect an expansion fit of the rod connector element within the hub components.

18. The method of claim 17 including the further step of providing an adhesive coating on the through openings of the hub components prior to the step of positioning the rod connector element therein.

19. The method of claim 17 wherein the hub components and the elongated rod connector element are all formed of the same base material to thereby prevent galvanic action therebetween when exposed to the atmosphere.

20. A method for securing together multiple hub components to form a connection for a plurality of elongated structural members comprising:

providing multiple hub components each having a central portion, an axial through opening and a plurality of ear pairs extending from the periphery thereof for receiving an end of the elongated structural member, stacking the hub components to axially align the through openings therein, rotating adjacent hub components relative to each other to provide an angular relationship of each ear pair on a hub component relative to an ear pair on the adjacent hub component selected from the angles of thirty, sixty and ninety degrees, providing an elongated rod connector element of slightly larger diameter than that of the through openings and applying pressure to force fit the elongated rod connector element within the axially aligned through openings, providing one end of the elongated rod connector element with a rounded tip surface extending from the connected hub components, drilling and tapping a hole within the rounded surface at a selected angle thereon, and bolting an ear pair to the rounded surface to receive an end of an elongated structural member.

* * * * *